US005595967A

United States Patent [19]

Miracle et al.

[11] Patent Number: 5,595,967

[45] Date of Patent: *Jan. 21, 1997

[54] DETERGENT COMPOSITIONS COMPRISING MULTIPERACID-FORMING BLEACH ACTIVATORS

[75] Inventors: Gregory S. Miracle, Hamilton; Mark R. Sivik, Fairfield; Patti J. Kellett, Cincinnati, all of Ohio

[73] Assignee: The Procter & Gamble Company, Cincinnati, Ohio

[ * ] Notice: The term of this patent shall not extend beyond the expiration date of Pat. No. 5,591,704.

[21] Appl. No.: 547,089

[22] Filed: Oct. 23, 1995

Related U.S. Application Data

[62] Division of Ser. No. 383,397, Feb. 3, 1995, Pat. No. 5,534, 179.

[51] Int. Cl.[6] ..... C11D 3/26; C11D 3/39; C11D 3/395

[52] U.S. Cl. ..... 510/372; 510/292; 510/303; 510/305; 510/309; 510/314; 510/376; 510/504; 560/144; 560/145; 558/6; 558/9; 558/265

[58] Field of Search ..... 252/102, 186.38, 252/528, 547; 510/292, 303, 305, 309, 314, 372, 376, 504; 558/6, 9, 265; 560/144, 145

[56] References Cited

U.S. PATENT DOCUMENTS

| | | | |
|---|---|---|---|
| 4,260,529 | 4/1981 | Letton | 252/547 |
| 4,283,301 | 8/1981 | Diehl | 252/98 |
| 4,397,757 | 8/1983 | Bright et al. | 252/186.41 |
| 4,539,130 | 9/1985 | Thompson et al. | 252/94 |
| 4,751,015 | 6/1988 | Humphreys et al. | 252/99 |
| 4,818,426 | 4/1989 | Humphreys et al. | 252/99 |
| 4,853,143 | 8/1989 | Hardy et al. | 252/102 |
| 4,904,406 | 2/1990 | Darwent et al. | 252/102 |
| 4,988,451 | 1/1991 | Nunn et al. | 252/95 |
| 4,988,817 | 1/1991 | Madison et al. | 546/222 |
| 5,041,546 | 8/1991 | Venturello et al. | 540/484 |
| 5,071,584 | 12/1991 | Venturello et al. | 252/102 |
| 5,093,022 | 3/1992 | Sotoya et al. | 252/102 |
| 5,106,528 | 4/1992 | Francis et al. | 252/186.23 |
| 5,143,641 | 9/1992 | Nunn | 252/186.38 |
| 5,153,348 | 10/1992 | Kerschner et al. | 558/276 |
| 5,175,333 | 12/1992 | Kerschner et al. | 558/271 |
| 5,220,051 | 6/1993 | Sotoya et al. | 560/142 |
| 5,234,616 | 8/1993 | Mitchell et al. | 252/102 |
| 5,245,075 | 9/1993 | Venturello et al. | 560/302 |
| 5,259,981 | 11/1993 | Chapple et al. | 252/95 |
| 5,268,003 | 12/1993 | Coope et al. | 8/111 |
| 5,269,962 | 12/1993 | Brodbeck et al. | 252/186.25 |

FOREIGN PATENT DOCUMENTS

| | | | |
|---|---|---|---|
| 0068547 | 1/1983 | European Pat. Off. | C11D 3/39 |
| 0106584 | 4/1984 | European Pat. Off. | C11D 3/39 |
| 0540090A2 | 5/1993 | European Pat. Off. | C11D 17/00 |
| 0552812B1 | 5/1995 | European Pat. Off. | C07C 229/12 |
| 0408131B1 | 5/1995 | European Pat. Off. | C11D 3/39 |
| 3234796A | 10/1991 | Japan | C11D 3/39 |
| 06065598A | 8/1992 | Japan | C11D 11/99 |

OTHER PUBLICATIONS

U.S. application Ser. No. 08/383,398, filed Feb. 3, 1995, Sivik et al.

U.S. application Ser. No. 08/383,397, filed Feb. 3, 1995, Miracle et al.

U.S. application Ser. No. 08/546,874, filed Oct. 23, 1995, Sivik et al.

Kirk Othmer's Encyclopedia of Chemical Technology, 4th Ed., 1992, John Wiley & Sons, vol. 4, pp. 271–300 "Bleaching Agents (Survey)".

Pillersdorf and Katzhendler, Israel J. Chem. 18, 1979, 330–338.

CA 80:28403.

CA 81:107348.

CA 114:145871.

CA 114:166810.

CA 114:209601.

CA 114:231055.

CA 114:231056.

CA 115:73973.

CA 116:214155.

CA 119(18):183399e.

CA 120:253366.

*Primary Examiner*—Paul Lieberman

*Assistant Examiner*—Gregory R. Delcotto

*Attorney, Agent, or Firm*—Brian M. Bolam; Michael D. Jones; Kim W. Zerby

[57] ABSTRACT

Improved detergent compositions, especially granular detergents, comprising bleach activators which form multiperacids, especially specific monoquaternary substituted bis(peroxycarbonic) acids, upon perhydrolysis are provided.

11 Claims, No Drawings

DETERGENT COMPOSITIONS COMPRISING MULTIPERACID-FORMING BLEACH ACTIVATORS

This is a division of application Ser. No. 08/383,397, now U.S. Pat. No. 5,534,179, filed on Feb. 3, 1995.

FIELD OF THE INVENTION

The present invention is in the field of detergent compositions, especially those useful in domestic fabric laundering as well as in hard surface cleaning. Typical of such products are heavy-duty laundry detergents and bathroom cleaners having solid or liquid form. More particularly, the detergent compositions and wash baths herein comprise particular bleach activators which form multiperacids upon perhydrolysis.

BACKGROUND OF THE INVENTION

Despite ongoing innovation in this field, the provision of detergents with bleach remains a technically difficult endeavor. Bleaches are desirable for their stain-removing, dingy cleanup, whitening and sanitization properties; yet there are some frequently encountered disadvantages of effective bleaches. These include color damage on fabrics and damage to laundry appliances, especially the rubber hoses these appliances may contain. The most common bleaches are oxidants and are often difficult to coformulate with the current, improved but still oxidation-prone enzymes and other detergent ingredients. Moreover the legislated removal of phosphate builders from detergents in some geographies makes it neccessary to develop bleaches which operate effectively in the presence of nonphosphate builders which can be bleach-sensitive or may leave relatively high levels of calcium and magnesium in the water as compared to fully phosphated builder systems.

Modem bleaches for detergents include those comprising a hydrogen peroxide source, such as sodium perborate, and a bleach activator. The term "bleach activator" as used in the art refers to a compound which reacts with hydrogen peroxide or its anion to form a more effective oxidant. Known bleach activators include perhydrolyzable acyl compounds having a leaving group such as oxybenzenesulfonate. Detergents in the market today moreover include those in which the relatively mild and enzyme-compatible hydrogen peroxide source is combined with detersive enzymes; optionally with tetraacetylethylenediamine (TAED) or nonanoyloxybenzenesulfonate (NOBS) as bleach activators. It would be desirable to further improve these detergents, for example, by adding additional bleach activator types which extend the variety of stains removed. Achieving such improvement however brings with it a high risk of potential adverse effects, such as those noted supra. Numerous bleach activators may have other deficiencies, such as low enzyme compatibility, limited storage stability, low mass efficiency, surfactant incompatibility, tendencies to produce malodorous peracids, synthesis difficulty, lack of biodegradability, and high cost. These factors perhaps account for the observation that although strenuous efforts have been made to improve the efficacy of bleach activators and hundreds of such activators have been described in the literature, only TAED and NOBS have been widely successful.

The disclosure of many bleach activators in the context of laundry formulations includes the suggestion that quaternary substituted versions of such activators may indeed be of a depositing nature and, in consequence, have desirable fabric conditioning properties. See, for example, U.S. Pat. No. 4,751,015 at col. 3, lines 22–27. This patent as well as EP 427,224 and EP 408,131 are also illustrative of disclosures of bleach activators which may include chemical groups which may be cationic and/or which may form peroxycarbonic acids when perhydrolyzed.

Among the many efforts which have been made to improve bleach activators for laundry purposes, it has also been disclosed that diperacids can have beneficial effects. See, for example, Kirk Othmer's Encyclopedia of Chemical Technology, 4th. Ed., 1992, John Wiley & Sons, Vol. 4, ppg. 271–300, "Bleaching Agents (Survey)" which includes reference to diperoxydodecanedioic acid (DPDA) and its homologs. Such compounds have the formula $HOOC(O)(CH_2)_nC(O)OOH$ wherein n is typically 10 but can in general range more widely. Although the peroxy moieties of the diperacid are ionizable and hydrophilic, such diperacids contain in addition only a non-hydrophilic aliphatic "spacer", $—(CH_2)_n—$, separating the two peracid moieties. In short, they do not contain peroxide-free hydrophiles of the types and substitution positions described hereinafter. By way of additional diperacid disclosures, EP 68,547 describes aromatic diperoxyacids. U.S. Pat. Nos. 5,071,584, 5,041,546 and EP 316,809 describe heterocyclic polypercarboxylic acids and/or salts of amino-polypercarboxylic acids. As in the case of DPDA, such compounds lack a strongly hydrophilic moiety situated in-between the peracid moieties.

These improvements notwithstanding, there is no widely commercialized laundry detergent comprising a cationic or diperacid-forming bleach activator.

It is accordingly an object herein to provide improved detergent compositions and hard surface cleaners comprising particularly selected bleach activators, formulated to deliver superior cleaning and stain removal while reducing color fading and other deficiencies of art-disclosed detergent compositions which rely on cationic bleach activators.

BACKGROUND ART

Pillersdorf and Katzhendler, Israel J. Chem. 18, 1979, 330–338 describe certain monocarbonate compounds which may have utility as laundry bleach activators. Kirk Othmer's Encyclopedia of Chemical Technology, 4th. Ed., 1992, John Wiley & Sons, Vol. 4, ppg. 271–300, "Bleaching Agents (Survey)" reviews bleaches including peroxycarboxylic acids. U.S. Pat. No. 4,260,529 discloses certain unusual cationic surfactants which may be useful bleach activators.

Known quaternary substituted bleach activators are illustrated in U.S. Pat. Nos. 4,539,130; 4,283,301; GB 1,382,594; U.S. Pat. Nos. 4,818,426; 5,093,022; 4,904,406; EP 552,812; and EP 540,090 A2.

U.S. Pat. Nos. 4,988,451; 4,751,015; EP 427,224; EP 408,131; U.S. Pat. Nos. 5,268,003; 5,071,584; 5,041,546; EP 316,809; EP 68,547; EP 106,584; U.S. Pat. Nos. 4,818,426; 5,106,528; 5,234,616; GB 836,988; JP Laid-Open 6-655,598; EP 369,511; EP 475,511; EP 475,512; EP 475,513; JP Laid-Open 3-234-796; EP 507,475; U.S. Pat. Nos. 4,853,143; 5,259,981; and the following Chemical Abstracts: CA 119(18):183399e; CA 81:107348; CA 80:28403; CA 120:253366; CA 116:214155; CA 115:73973; CA 114:231056; CA 114:231055; CA 114:209601; CA114:166810 and CA 114:145871 all relate to bleach activators or peracids, with an emphasis on peroxycarbonic acid-forming systems.

SUMMARY OF THE INVENTION

It has now unexpectedly been discovered that detergent compositions are significantly improved compared with otherwise similar formulations comprising cationic bleach activators, when the bleach activator selected is one which forms specific types of multiperacid upon perhydrolysis. In particular, the detergent compositions encompassed herein are those comprising an effective amount of a bleach activator wherein said bleach activator undergoes perhydrolysis to form a multiperacid wherein at least one peroxy moiety of said peracid is a peroxycarbonic acid moiety; and wherein said peracid comprises at least one peroxide-free hydrophile as illustrated in detail hereinafter; provided that said multiperacid comprises no more than one amido or quaternary nitrogen moiety. In general, the multiperacid comprises 2 or more, preferably from 2 to about 8, more preferably from 2 to about 4 peroxy moieties selected from the group consisting of peroxycarbonic acid moieties, peroxycarboxylic acid moieties; peroxyimidic acid moieties and mixtures thereof, always provided that the need for at least one peroxycarbonic moiety is respected. The bleach activators of this invention preferably do not comprise long-chain moieties, for example $C_{16}$ or higher; in the preferred embodiments, the selected bleach activators have low tendency to comicellize with surfactants: when surface-active, they preferably are highly water-soluble and have critical micelle concentrations of $10^{-1}$ molar or higher.

Without intending to be limited by theory, it is believed that the hereinbefore referenced U.S. Pat. No. 4,751,015 and other references teaching the desirability of deposition of the bleach activator on fabrics are mistaken. In fact, such deposition may lead to increased color fading. According to the present invention, it is instead desirable to minimize the deposition of the selected bleach activator. This is but one of the accomplishments of the present bleach activator selection. Bleach activators selected herein for example have reduced color fading compared with otherwise very similar bleach activators which contain but a single peroxyacid forming moiety and/or have two or more cationic moieties.

The term "perhydrolysis" as used supra is well known in the art and relates to the reaction of a bleach activator with hydrogen peroxide to form a peracid. For example a common bleach activator structure in the art is one having the form RC(O)L wherein RC(O) is an acyl moiety and L is a leaving-group. The activator reacts with hydrogen peroxide or a hydrogen peroxide source such as sodium percarbonate or perborate, typically in alkaline aqueous solution, to form a peracid, typically a percarboxylic acid RC(O)OOH or its anion, with loss of a leaving-group, L, or its conjugate acid LH.

The terms "peracid" and "peroxyacid" are sometimes used interchangeably in the art and are equivalent terms herein.

The selected bleach activators herein may in one mode be conveniently described by reference to the peracids they form when perhydrolyzed. It is convenient to do this, inter-alia because it permits unambigous identification of the location of particular hydrophilic substituents. In accordance with the invention certain such substituents must be located inside the multiperacid-forming portion of the bleach activator rather than inside a leaving-group. In general, the leaving groups of the selected bleach activators herein may vary widely. The term "leaving group" is defined in standard texts, such as "Advanced Organic Chemistry", J. March, 4th Ed., Wiley, 1992, p 205. The term "multiperacid" as used herein refers to a peroxy organic compound or peracid having two or more acidic —OOH moieties. It should be understood that such moieties encompass both the protonated and deprotonated, i.e., peroxyanion —OO— forms,: these forms are, of course, interconvertible depending on their $pK_a$ and the conditions of pH and concentration.

In all preferred detergent compositions herein, the bleach activator is one which is capable of forming a multiperacid comprising at least one peroxide-free hydrophile, preferably situated between two peroxy moieties. This hydrophile is in addition to the inherently hydrophilic peracid moieties present. In general, the term "peroxide-free hydrophile" (PFH) is used to distinguish non-bleaching hydrophiles useful in the instant bleach activators from the inherently hydrophilic peroxyacid moieties. PFH's are nonlimitingly illustrated by any member selected from the group consisting of:

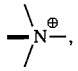

sulfate, sulfonate, amino, polyoxyalkylene, amine oxide, carboxylate, hydroxyl, phosphonium and phosphate. Preferred are

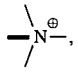

polyoxyalkylene, and sulfonate; more preferable is

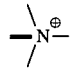

or polyoxyalkylene (especially polyoxyethylene). Moieties which may be present in the multiperacids, but which do not consititute peroxide-free hydrophiles include those selected from the group consisting of sulfones, sulfoxides, non-polyoxyalkylene-type (e.g. dialkyl ethers) and amides.

Importantly, in preferred embodiments of this invention when a

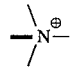

moiety is present, there is only one such moiety. In the foregoing, the bolded valency refers to a valency through which the moiety is covalently connected to the bleach activator and the non-bolded valencies may in general be connected to any suitable group, such as methyl, ethyl, propyl or butyl. All PFH's herein are generally covalently connected to the bleach activator.

It may accordingly be seen that whereas multiperacid-forming bleach activators of the art without PFH's can be useful herein as optional materials, the preferred detergents of the invention are those wherein a PFH is present in specific position, notably, one outside the leaving-groups. Moreover, the PFH will preferably be positioned in-between any two peracid-forming moieties in the bleach activator, either "in-line" or as part of a side-chain. Additional PFH-type moieties may, optionally, be present, either in the same portion of the bleach activator, or forming part of leaving-groups of the bleach activator, but the presence of at least one PFH and, when said PFH is quaternary nitrogen, no more than one PFH, within the peracid-forming portion of the bleach activator is essential.

In still more preferable embodiments, there is encompassed a detergent or hard-surface cleaning composition wherein said multiperacid comprises 2 of said peroxy moieties and further wherein each of said peroxy moieties is a peroxycarbonic acid moiety.

In a highly preferred embodiment, the development includes a laundry detergent composition comprising a bleach activator selected from

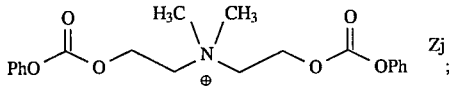

(I)

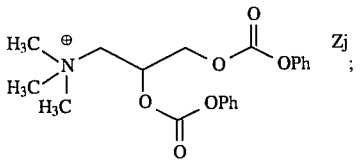

(II)

and mixtures thereof.

In the foregoing structures, the PFH is

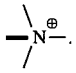

Short-chain methyl moieties which do not reduce the water solubility of the bleach activator, are attached thereto. These bleach activators comprise phenoxy leaving-groups, though in general, alternate leaving-groups may be substituted therefor. These bleach activators form bis(peroxycarbonic) acids as the multiperacid when they are fully perhydrolyzed.

The detergent compositions of this invention preferably have an aqueous pH in the range from about 7 to about 12. The detergent compositions of this invention are preferably substantially free from phosphate builders and chlorine bleach and typically comprise a hydrogen peroxide source, preferably selected from the group consisting of perborate salts, percarbonate salts and mixtures thereof. Other optional adjunct ingredients are disclosed hereinafter.

The instant invention also encompasses detergent wash baths comprising an effective mount of a multiperacid wherein at least one peroxy moiety of said multiperacid is a peroxycarbonic acid moiety; and wherein said multiperacid comprises at least one peroxide-free hydrophile; provided that said multiperacid comprises no more than one amido or quaternary nitrogen moiety. The detergent wash bath will typically comprise from about 0.2 ppm to about 400 ppm of said multiperacid. Preferred multiperacids comprise from 2 to about 4 peracid moieties selected from the group consisting of peroxycarbonic acid, peroxycarboxylic acid, peroxyimidic acid, and mixtures thereof. Highly preferred multiperacids comprise 2 peroxycarbonic acid moieties. A detergent wash bath is formed by adding a bleaching composition of this invention to an aqueous wash bath comprising an oxygen bleach source.

The present invention also encompasses novel bleach activators which are preferred for use in the instant compositions.

All percentages and proportions herein are by weight, and all references cited are hereby incorporated by reference, unless otherwise specifically indicated.

DETAILED DESCRIPTION OF THE INVENTION

Detergent Compositions—In general, detergent compositions herein are used at a level of from about 800 to about 8,000 ppm in water. Compositions of the present invention suitably comprise a source of hydrogen peroxide and a particularly selected bleach activator. The source of hydrogen peroxide in the detergent compositions is any common hydrogen-peroxide releasing salt, such as sodium perborate or sodium percarbonate. In the preferred embodiments, additional ingredients such as deter five surfactants for enhanced greasy and particulate soil removal, dispersant polymers to modify and inhibit crystal growth of calcium and/or magnesium salts, chelants to control transition metals, builders to control calcium and/or magnesium and assist buffering action, alkalis to adjust pH, detersive enzymes to assist with tough cleaning, especially of starchy and proteinaceous soils, and soil release polymers, are present. Preferably, additional bleach-modifying materials such as bleach catalysts or conventional bleach activators, especially NOBS but alternately and less preferably also TAED and/or other conventional bleach activators may be added, provided that any such bleach-modifying materials are delivered in such a manner as to be compatible with the purposes of the present invention. The present detergent compositions may, moreover, comprise one or more fabric conditioners, processing aids, fillers, perfumes, conventional enzyme particle-making materials including enzyme cores or "nonpareils", pigments or blueing agents, fluorescent whitening agents, anti-redeposition aids such as carboxymethylcellulose, and the like. In general, materials used for the production of detergent compositions herein are preferably checked for compatibility with the intended end-result. For example, hard surface cleaners, while they may include thickeners and other adjuncts will typically avoid inclusion of ingredients which may leave unsightly deposits on the surfaces being cleaned. Test methods for cleaning and deposition are generally described in the detergent literature, including DIN test methods.

Amounts of the essential ingredients can vary within wide ranges; however, preferred detergent compositions herein (which typically have a 1% aqueous solution pH of from about 7 to about 12, more preferably from about 8 to about 10.5) are those wherein there is present: from about 0.1% to about 70%, preferably from about 0.5% to about 30% of a source of hydrogen peroxide; from about 0.1% to about 30%, preferably from about 0.1% to about 10% of the essential bleach activator; this bleach activator optionally being complemented by a conventional bleach activator such as NOBS at a typical level of from 0% to about 5%; from about 0.1% to about 70%, preferably from about 1% to about 20% of a detersire surfactant; and from about 0.1% to about 70%, preferably from about 1% to about 40% of a builder. Such fully-formulated embodiments preferably further comprise from about 0.1% to about 15% of a polymeric dispersant, from about 0.01% to about 10% of a chelant, from about 0.00001% to about 10% of a detersire enzyme though further additional or adjunct ingredients, especially soil release polymers, may be present.

Bleach Activator—The present compositions comprise an effective amount or a stain removal-improving amount of a particularly defined bleach activator or the corresponding multiperacid, for example as formed by aqueous alkaline perhydrolysis of the bleach activator in the presence of hydrogen peroxide.

An "effective amount" or "stain removal-improving amount" of a bleach activator or its corresponding multiperacid is any amount capable of measurably improving stain removal (especially of tea stains) from soiled fabrics or surfaces when washed by the consumer. In general, this amount may vary quite widely. Preferred levels are illustrated hereinabove.

The bleach activators essential in the instant compositions consist essentially of a particularly defined multiperacid-forming moiety, leaving-groups, and, when the charge requires to be balanced, counter-ions.

In more detail, the bleach activators useful herein are selected from:

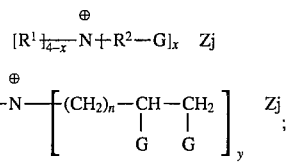

(I)

(II)

(III) mixtures thereof.

The number x is an integer from 2 to 4; y is an integer from 1 to 4; n is an integer from 1 to 6, provided that any n may be independently selected for each

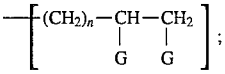

each G is independently selected from the group consisting of

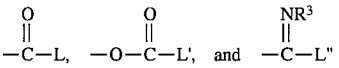

wherein $R^3$, when present, is selected from $C_1$–$C_{12}$ alkyl and $C_6$–$C_{12}$ aryl and wherein L, L' and L" are leaving groups. Each $R^1$ is independently selected from the group consisting of alkyl, alkenyl, alkynyl, cycloalkyl, cycloalkenyl, alkaryl, aryl, phenyl, hydroxyalkyl, and polyoxyalkylene; each $R^2$, when present, is independently selected from alkylene, cycloalkylene, alkylenephenylene, phenylene, arylene, alkoxyalkylene, polyalkoxyalkylene, and hydroxyalkylene, any $R^2$ being substituted with a moiety selected from H, $C_1$–$C_{20}$ alkyl, alkenyl, aryl, aralkyl, and alkaryl; Z is an oxidation compatible counter-ion (in general such an ion may be a cation, such as sodium, or an anion—preferred counter-anions are described more fully hereinafter); and j is a number which is selected such that said bleach activator is electrically neutral.

Preferred leaving groups are those independently selected from the group consisting of

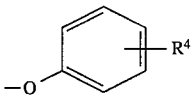

wherein $R^4$ is selected from —H, —$CO_2R_5$, —$OR^5$ and —$R^5$ wherein $R^5$ is selected from $C_1$–$C_{12}$ alkyl. A highly preferred leaving-group is one wherein $R^4$ is —H, that is to say, the leaving-group has the formula

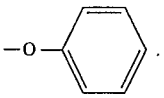

Such a leaving-group is preferred on account of superior economy and effectiveness.

More generally, as noted, the leaving groups L, L' and L" may vary widely. Suitable leaving-groups are illustrated by any of the following:

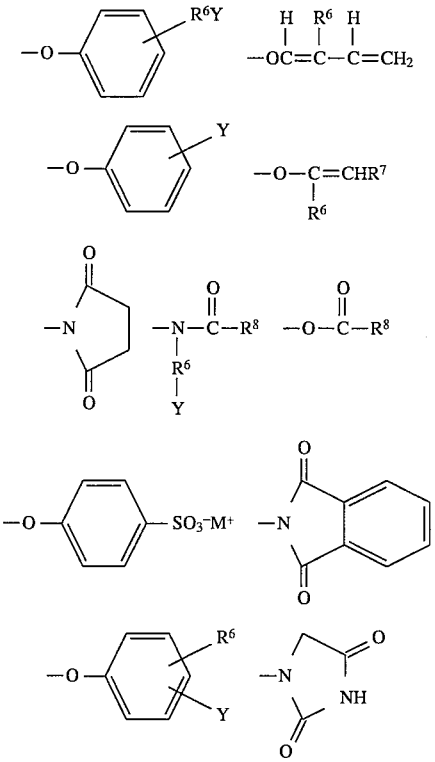

wherein M is sodium, potassium or ammonium, preferably sodium, and any $R^6$, $R^7$ or $R^8$ is suitably $C_1$–$C_{12}$ alkyl. $R^6$ or $R^7$ may alternately be hydrogen. Y is suitably selected from —$(SO_3^-)$M, —$(C(O)O)^-$M, —$(C(O)OR^6)$, —$(SO_4^=)$M, —$(NR(R^6)_3)^+X^-$, —$NO_2$, —OH, O→$N(R_6)_2$— and mixtures thereof wherein M and $R^6$ are as defined supra and $X^-$ is an anion similar to Z defined eleswhere herein, to supply electroneutrality.

Preferred embodiments of bleach activators of formula (I) are those wherein x is 2 or 3; the moieties G are selected from

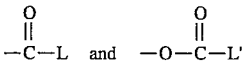

wherein at least one G is

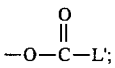

$R^1$ is $C_1$—$C_8$ alkyl, benzyl, 1-naphthylmethylene or 2-naphthylmethylene, provided that no more than one $R^1$ is different from $C_1$–$C_4$ alkyl and $R^5$, when present, is methyl.

In a highly preferred embodiment of formula (I), x is 2; each G is

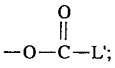

$R^1$ is $C_1$–$C_4$ alkyl or benzyl; $R^2$ is ethylene or propylene; and $R^4$ is H.

In a preferred embodiment of formula (II), y is from 1 to 2; at least one G is $$-O-\overset{\overset{\displaystyle O}{\|}}{C}-L';$$

all moieties G are selected from $$-\overset{\overset{\displaystyle O}{\|}}{C}-L \quad \text{and} \quad -O-\overset{\overset{\displaystyle O}{\|}}{C}-L';$$

n is from 1 to 4; $R^1$ is $C_1$–$C_8$ alkyl, benzyl, 1-naphthylmethylene or 2-naphthylmethylene provided that no more than one $R^1$ is different from $C_1$–$C_4$ alkyl; and $R^5$, when present, is methyl.

In a highly preferred embodiment of formula (II), y is 1; G is $$-O-\overset{\overset{\displaystyle O}{\|}}{C}-L';$$

n is 1; $R^1$ is $C_1$–$C_4$ alkyl or benzyl; and $R^4$ is H.

Counter-anions—Preferred compositions of this invention comprise charge-balancing compatible anions or "counter-ions", identified as "Z" in the bleach activators herein. An index, "j", refers to the number of such counter-ions in the bleach activator. In general, the counter-anions may be monovalent, divalent, trivalent or polyvalent. Available anions such as bromide, chloride or phosphates may be used, though they may be other than preferred for one or another reason, such as bleach reactivity or phosphorus content. Preferred compatible anions are selected from the group consisting of sulfate, isethionate, alkanesulfonate, alkyl sulfate, aryl sulfonate, alkaryl sulfonate, carboxylates, polycarboxylates, and mixtures thereof. Preferred anions include the sulfonates selected from the group consisting of methanesulfonate, ethanesulfonate, benzenesulfonate, p-toluenesulfonate, cumenesulfonate, xylenesulfonate, naphthalene sulfonate and mixtures thereof. Especially preferred of these sulfonates are those which contain aryl. Preferred alkyl sulfates include methyl sulfate and octyl sulfate. Preferred polycarboxylate anions suitable herein are nonlimitingly illustrated by terephthalate, polyacrylate, polymaleate, poly (acrylate-comaleate), or similar polycarboxylates; preferably such polycarboxylates have low molecular weights, e.g., 1,000–4,500. Suitable monocarboxylates are further illustrated by benzoate, naphthoate, p-toluate, and similar hard-water precipitation-resistant monocarboxylates.

Highly Preferred Bleach Activators and Multiperacids

As noted in the summary, highly preferred detergent compositions herein comprise bleach activators having the following structures:

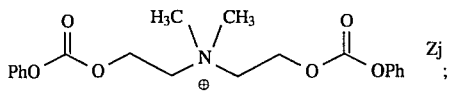

(I)

and

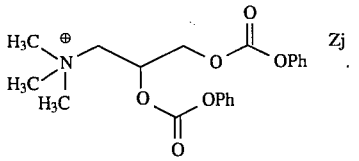

(II)

Also within the spirit and scope of the invention are detergent wash baths comprising these activators or the corresponding multiperacids, formed when the bleach activators are reacted with hydrogen peroxide at an alkaline pH provided by alkaline components, such as builders and alkalis, of the detergent more fully described hereinafter. The corresponding multiperacids have the following structures:

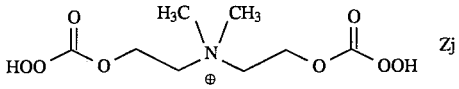

and

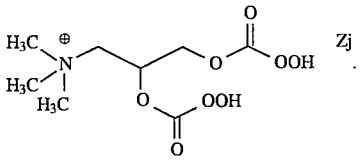

With reference to the term "peracid-forming moiety" introduced hereinabove, the preferred bleach activator having structure (I) comprises a peracid-forming moiety having the structure:

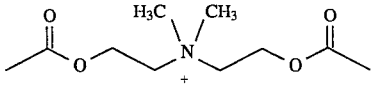

which together with the leaving-groups

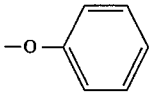

and j counter-ions Z constitute the complete bleach activator.

Also within the spirit and scope of the invention, in accordance with the formulas given hereinabove, are detergents comprising bleach activator wherein the multiperacid-forming moiety is substituted by a neutral peroxy free hydrophile, such as polyoxyethyleneoxy, or by an anionic peroxy-free hydrophile, such as a sulfonated aromatic. Moreover, the peracid-forming moiety may be symmetric or unsymmetric with respect to the type of peracid formed, the latter case being illustrated by:

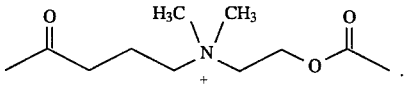

Hydrogen Peroxide Source—Hydrogen peroxide sources are described in detail in the hereinabove incorporated Kirk Othmer review on Bleaching and include the various forms of sodium perborate and sodium percarbonate, including various coated and modified forms. An "effective amount" of a source of hydrogen peroxide is any amount capable of measurably improving stain removal (especially of tea or coffee stains) from soiled articles compared to a hydrogen peroxide source-free composition when the soiled articles are washed by the consumer in a domestic washing-machine in the presence of alkali.

More generally a source of hydrogen peroxide herein is any convenient compound or mixture which under consumer use conditions provides an effective amount of hydrogen peroxide. Levels may vary widely and are usually in the range from about 0.1% to about 70%, more typically from about 0.5% to about 30%, by weight of the compositions herein.

The preferred source of hydrogen peroxide used herein can be any convenient source, including hydrogen peroxide itself, the latter especially in the hard-surface cleaning embodiments. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Sodium perborate monohydrate and sodium percarbonate are particularly preferred. Mixtures of any convenient hydrogen peroxide sources can also be used.

A preferred percarbonate bleach for laundry granules comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

While effective bleaching compositions herein may comprise only the identified bleach activators and a source of hydrogen peroxide, fully-formulated detergent compositions typically will also comprise other adjunct ingredients to improve or modify performance.

Detersive Surfactants—Surfactants are useful herein for their usual cleaning power and may be included in preferred embodiments of the instant detergent compositions at the usual detergent-useful levels. Depending on the precise application, such compositions are better than the surfactant-free counterparts for overall cleaning and bleaching performance and may be synergistic. In general, bleach-stable detersive surfactants are preferred: for example, for long-term storage stability, particularly of liquid-form detergent compositions comprising bleach, it is preferable to use detersive surfactants in which the total content of bleach-reactive unsaturated surface-active material or other impurity components is minimized.

Nonlimiting examples of surfactants useful herein include the conventional $C_{11}$–$C_{18}$ alkylbenzene sulfonates ("LAS") and primary, branched-chain and random $C_{10}$–$C_{20}$ alkyl sulfates ("AS"); the $C_{10}$–$C_{18}$ secondary alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium; unsaturated sulfates such as oleyl sulfate; the $C_{10}$–$C_{18}$ alkyl alkoxy sulfates ("$AE_xS$") especially those wherein x is from 1 to about 7; $C_{10}$–$C_{18}$ alkyl alkoxy carboxylates (especially the EO 1–5 ethoxycarboxylates); the $C_{10}$–$C_{18}$ glycerol ethers; the $C_{10}$–$C_{18}$ alkyl polyglycosides and their corresponding sulfated polyglycosides; and $C_{12}$–$C_{18}$ alpha-sulfonated fatty acid esters. Detersive surfactants may be mixed in varying proportions for improved surfactancy as is well-known in the art. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxylate/propoxylates), $C_{12}$–$C_{18}$ betaines and sulfobetaines ("sultaines"), $C_{10}$–$C_{18}$ amine oxides, and the like, can also be included in the cleaning compositions, The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used. $C_{10}$–$C_{20}$ conventional soaps may also be employed. The branched-chain $C_{10}$–$C_{16}$ soaps are also useful. Mixtures of anionic and nonionic surfactants are especially useful.

Additionally desirable detersive surfactants for use herein are cationic surfactants such as the alkyltrimethylammonium chlorides and bromides, more particularly the $C_{12}$–$C_{14}$ alkyltrimethylammonium derivatives. Any other convenient cationic surfactant may be used.

Additionally desirable are cationic plus nonionic surfactant systems. Other conventional useful surfactants are listed in standard texts.

Chelating Agents—The compositions herein may also optionally contain one or more transition-metal selective sequestrants, "chelants" or "chelating agents", e.g., iron and/or copper and/or manganese chelating agents. Chelating agents suitable for use herein can be selected from the group consisting of aminocarboxylates, phosphonates (especially the aminophosphonates), polyfunctionally-substituted aromatic chelating agents, and mixtures thereof. Without intending to be bound by theory, it is believed that the benefit of these materials is due in part to their exceptional ability to control iron, copper and manganese in washing solutions; other benefits include inorganic film prevention or scale inhibition. Commercial chelating agents for use herein include the DEQUEST® series, and chelants from Monsanto, DuPont, and Nalco, Inc.

Aminocarboxylates useful as optional chelating agents are further illustrated by ethylenediaminetetracetates, N-hydroxyethylethylenediaminetriacetates, nitrilotriacetates, ethylenediamine tetraproprionates, triethylenetetraaminehexacetates, diethylenetriamine-pentaacetates, and ethanoldiglycines, alkali metal, ammonium, and substituted ammonium salts thereof. In general, chelant mixtures may be used for a combination of functions, such as multiple transition-metal control, long-term product stabilization, and/or control of precipitated transition metal oxides and/or hydroxides.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A highly preferred biodegradable chelator for use herein is ethylenediamine disuccinate ("EDDS"), especially (but not limited to) the [S,S]isomer as described in U.S. Pat. No. 4,704,233, Nov. 3, 1987, to Hartman and Perkins. The trisodium salt is preferred though other forms, such as magnesium salts, may also be useful.

Aminophosphonates are also suitable for use as chelating agents in the compositions of the invention when at least low levels of total phosphorus are permitted in detergent compositions, and include the ethylenediaminetetrakis (methylenephosphonates) and the diethylenetriaminepentakis (methylene phosphonates). Preferably, these aminophosphonates do not contain alkyl or alkenyl groups with more than about 6 carbon atoms.

If utilized, chelating agents or transition-metal-selective sequestrants will preferably comprise from about 0.001% to about 10%, more preferably from about 0.05% to about 1% by weight of the compositions herein.

Builders—Detergent builders, including silicates, can optionally be included in the compositions herein to assist in controlling mineral hardness or for other useful purposes, such as to reduce corrosion of appliance components. Inorganic as well as organic builders can be used. Builders are typically used in fabric laundering compositions, for example to assist peptization of particulate soils.

The level of builder can vary widely depending upon the end use of the composition and its desired physical form. When present, the compositions will typically comprise at least about 1% builder. High performance compositions typically comprise from about 10% to about 80%, more typically from about 15% to about 50% by weight, of the detergent builder. Lower or higher levels of builder, however, are not excluded.

Inorganic or P-containing detergent builders include, but are not limited to, the alkali metal, ammonium and alkanolammonium salts of polyphosphates (exemplified by the tripolyphosphates, pyrophosphates, and glassy polymeric rectaphosphates), phosphonates, phytic acid, silicates, carbonates (including bicarbonates and sesquicarbonates), sulfates, and aluminosilicates. However, non-phosphate builders are required in some locales. Compositions herein function surprisingly well even in the presence of "weak" builders (as compared with phosphates) such as citrate, or in the so-called "underbuilt" situation that may occur with zeolite or layered silicate builders. See U.S. Pat. No. 4,605,509 for examples of preferred aluminosilicates.

Examples of carbonate builders are the alkaline earth and alkali metal carbonates as disclosed in German Patent Application No. 2,321,001 published on Nov. 15, 1973. Various grades and types of sodium carbonate and sodium sesquicarbonate may be used, certain of which are particularly useful as carriers for other ingredients, especially detersive surfactants.

Aluminosilicate builders may be used in the present compositions. They can be crystalline or amorphous in structure and can be naturally-occurring aluminosilicates or synthetically-derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred laundry embodiment, the crystalline aluminosilicate ion exchange material used is Zeolite A. Various modifications are useful, thus dehydrated or partially hydrated zeolite A may also be used, as can a wide range of particle sizes. Preferably, the aluminosilicate has a mean particle diameter of from about 0.1 to about 10 microns. Individual particles can desirably be even smaller than 0.1 micron to further assist kinetics of exchange through maximization of surface area. High surface area also increases utility of aluminosilicates as adsorbents for surfactants, especially in granular compositions. Aggregates of silicate or aluminosilicate particles may be useful, a single aggregate having dimensions tailored to minimize segregation in granular compositions, while the aggregate particle remains dispersible to submicron individual particles during the wash. As with other builders such as carbonates, it may be desirable to use zeolites in any physical or morphological form adapted to promote surfactant carrier function, and appropriate particle sizes may be freely selected by the formulator.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediaminetetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty laundry detergents due to their availability from renewable resources and their biodegradability. Citrates can also be used in combination with zeolite and/or so-called disilicate or layered silicate builders. Oxydisuccinates are also useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing in laundry compositions, which may need to be be taken into account by the formulator. Fatty acids or their salts are undesirable in embodiments in situations wherein soap scums can form and be deposited on substrates where such scums or films would be visually objectionable.

Where phosphorus-based builders can be used, the various alkali metal phosphates such as the well-known sodium tripolyphosphates, sodium pyrophosphate and sodium orthophosphate can be used. Phosphonate builders such as ethane-b 1-hydroxy-1,1-diphosphonate and other known phosphonates (see, for example, U.S. Pat. Nos. 3,159,581; 3,213,030; 3,422,021; 3,400,148 and 3,422,137) can also be used though such materials are more commonly used in a low-level mode as chelants or stabilizers.

The present detergent compositions may further comprise a water-soluble silicate. Water-soluble silicates herein are any silicates which are soluble to the extent that they produce a measurable change in pH when added to pure water.

Examples of silicates are sodium metasilicate and, more generally, the alkali metal silicates, particularly those having a $SiO_2$:$Na_2O$ ratio in the range 1.6:1 to 3.2:1; and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, Na SKS-6 and other water-soluble silicates or disilicates useful herein do not contain aluminum NaSKS-6 is the δ-$Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS-11, as the α-, β- and γ- forms. Other silicates may also be useful, such as for example magnesium silicate, which can serve as a crispening agent in granular formulations, as a stabilizing agent for oxygen bleaches, and as a component of suds control systems.

Silicates optionally useful herein include granular hydrous 2-ratio silicates such as BRITESIL® $H_2O$ from PQ Corp., and the commonly sourced BRITESIL® H24 though liquid grades of various silicates can be used when the composition has liquid form. Within safe limits, sodium metasilicate or sodium hydroxide alone or in combination with other silicates may be used to boost wash pH to a desired level.

Detersive Enzymes—"Detersive enzyme", as used herein, means any enzyme having a cleaning, stain removing or otherwise beneficial effect in a detergent composition. Preferred detersive enzymes are hydrolases such as proteases, amylases and lipases. Highly preferred for are amylases and/or proteases, including both current commercially available types and improved types which, though more bleach compatible, have a remaining degree of bleach deactivation susceptibility.

In general, as noted, preferred detergent compositions herein comprise one or more detersive enzymes. If only one enzyme is used, it is preferably a proteolytic enzyme when the composition is for laundry use. Highly preferred is a mixture of proteolytic enzymes and amyloytic enzymes. More generally, the enzymes to be incorporated include proteases, amylases, lipuses, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics or other substrates being cleaned. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.001% to about 6%, preferably 0.01%–1% by weight of a commercial enzyme preparation. Protease enzymes are usually present in such commercial preparations at levels sufficient to provide from 0.005 to 0.1 Anson units (AU) of activity per gram of composition. For compact detergent purposes, it may be desirable to increase the active enzyme content of the commercial preparations, in order to minimize the total amount of non-catalytically active materials delivered.

Suitable examples of proteases are the subtilisins which are obtained from particular strains of *B. subtilis* and *B. lichenformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylases suitable herein include, for example, α-amylases described in British Patent Specification No. 1,296,839 (Novo), RAPIDASE®, International Bio-Synthetics, Inc. and TERMAMYL®, Novo Industries.

Engineering of enzymes for improved stability, e.g., oxidative stability, is known. See, for example J. Biological Chem., Vol. 260, No. 11, June 1985, pp 6518–6521. "Reference amylase" refers to a conventional amylase inside the scope of the amylases useful in this invention. Further, stability-enhanced amylases, also useful herein, are typically superior to these "reference amylases".

The present invention, in certain preferred embodiments, can make use of amylases having improved stability in detergents, especially improved oxidative stability. A convenient absolute stability reference-point against which amylases used in these preferred embodiments of the instant invention represent a measurable improvement is the stability of TERMAMYL® in commercial use in 1993 and available from Novo Nordisk A/S. This TERMAMYL® amylase is a "reference amylase", and is itself well-suited for use in the (Detergent) compositions of the invention, as well as in inventive fabric laundering compositions herein. Even more preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which preferred amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the preferred embodiments of the invention can be obtained from Novo Nordisk A/S, or from Genencor International.

Preferred amylases herein have the commonality of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Cellulases usable in, but not preferred, for the present invention include both bacterial or fungal cellulases. Preferably, they will have a pH optimum of between 5 and 9.5. Suitable cellulases are disclosed in U.S. Pat. No. 4,435,307, Barbesgoard et al, issued mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum var. lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.* The LIPOLASE® enzyme derived from *Humicola lanuginosa* and commercially available from Novo (see also EPO 341,947) is a preferred lipase for use herein. Another preferred lipase enzyme is the D96L variant of the native *Humicola lanuginosa lipase,* as described in WO 92/05249 and Research Disclosure No. 35944, Mar. 10, 1994, both published by Novo. In general, lipolytic enzymes are less preferred than amylases and/or proteases for embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/0998 13, published Oct. 19, 1989, by O. Kirk, assigned to Novo Industries A/S. The present invention encompasses peroxidase-free composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of polymeric soil release agent (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents or anti-redeposition agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly(vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et at. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

If utilized, soil release agents will generally comprise from about 0.01% to about 10.0%, by weight, of the detergent compositions herein, typically from about 0.1% to about 5%, preferably from about 0.2% to about 3.0%.

Suds Suppressors—The compositions of the invention can optionally contain one or more suds suppressors, which may include one or more of the silicone types, fatty acids or soaps, aluminium tristearate, phosphate esters, low-solubility oils etc. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit phosphate ester-type suds suppressors entirely. Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Fetch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate end-blocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

If it is desired to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

OTHER OPTIONAL ADJUNCT INGREDIENTS

Bleach Adjuncts (a) Bleach catalysts—If desired, detergent compositions herein may additionally incorporate a catalyst or accelerator to further improve bleaching. Any suitable bleach catalyst can be used. Typical bleach catalysts comprise a transition-metal complex, often one wherein the metal co-ordinating ligands are quite resistant to labilization. Such catalyst compounds often have features of naturally occurring compounds but are principally provided synthetically and include, for example, the manganese-based catalysts disclosed in U.S. Pat. Nos. 5,246,621, 5,244,594; 5,194,416; 5,114,606; and European Pat. App. Pub. Nos. 549,271A1, 549,272A1, 544,440A2, and 544,490A1; preferred examples of these catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2(ClO_4)_2$, $Mn^{IV}_4(u\text{-}O)_6$(1,4,7-triazacyclononane)$_4(ClO_4)_4$, $Mn^{III}$-$Mn^{IV}_4$-$(u\text{-}O)_1(u\text{-}OAc)_2$-(1,4,7-trimethyl-1,4,7-triazacyclononane)$_2$-$(ClO_4)_3$, $Mn^{IV}$-(1,4,7-trimethyl-1,4,7-triazacyclononane)-$(OCH_3)_3(PF_6)$, and mixtures thereof; though alternate metal-coordinating ligands as well as mononuclear complexes are also possible and monometallic as well as di- and polymetallic complexes, and complexes of alternate metals such as iron are all within the present scope. Other metal-based bleach catalysts include those disclosed in U.S. Pat. Nos. 4,430,243 and 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

Said manganese can be precomplexed with ethylenediaminedisuccinate or separately added, for example as a sulfate salt, with ethylenediaminedisuccinate. (See U.S. application Ser. No. 08/210,186, filed Mar. 17, 1994.) Other preferred transition metals in said transition-metal-containing bleach catalysts include cobalt (see in particular U.S. Pat. No. 4,810,410 to Diakun et al., issued Mar. 7, 1989); ruthenium, rhodium, iridium, iron or copper may alternately be used.

As a practical matter, and not by way of limitation, the bleaching compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 50 ppm, or less, of the catalyst species in the wash liquor.

(b) Conventional Bleach Activators—"Conventional Bleach Activators" herein are any bleach activators not encompassed within the definition of the essential bleach activator component and are purely optional materials for the inventive compositions. If used, they will typically be supplements rather than replacements for the inventive combinations. Such activators are any known activators not specifically included in the essential bleach activator component. Such activators are typified by TAED (tetraacetylethylenediamine). Numerous conventional activators are known. See for example U.S. Pat. No. 4,915,854, issued Apr. 10, 1990 to Mao et al, and U.S. Pat. No. 4,412,934. Nonanoyloxybenzene sulfonate (NOBS) or acyl lactam activators may be used, and mixtures thereof with TAED can also be used. See also U.S. Pat. No. 4,634,551 for other typical conventional bleach activators. Also known are amido-derived bleach activators of the formulae: $R^1N(R_5)C(O)R_2C(O)L$ or $R_1C(O)N(RS)R_2C(O)L$ wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. Further illustration of bleach activators of the above formulae include (6-octanamido-caproyl)oxybenzenesulfonate, (6-nonanamidocaproyl)oxybenzenesulfonate, (6-decanamido-caproyl) oxybenzene sulfonate, and mixtures thereof as described in U.S. Pat. No. 4,634,551. Another class of bleach activators comprises the benzoxazin-type activators disclosed by Hodge et al in U.S. Pat. No. 4,966,723, issued Oct. 30, 1990. Still another class of bleach activators includes acyl lactam activators such as octanoyl caprolactam, 3,5,5-trimethylhexanoyl caprolactam, nonanoyl caprolactam, decanoyl caprolactam, undecenoyl caprolactam, octanoyl valerolactam, decanoyl valerolactam, undecenoyl valerolactam, nonanoyl valerolactam, 3,5,5-trimethylhexanoyl valerolactam, t-butylbenzoylcaprolactarn, t-butylbenzoylvalerolactam and mixtures thereof. The present compositions can optionally comprise aryl benzoates, such as phenyl benzoate.

(c) Organic Peroxides, especially Diacyl Peroxides—These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which deposits on substrates to a minimal extent.

Other Ingredients—Detersive ingredients or adjuncts optionally included in the instant compositions can include one or more materials for assisting or enhancing cleaning performance, treatment of the substrate to be cleaned, or designed to improve the aesthetics of the compositions. Adjuncts which can also be included in compositions of the present invention, at their conventional art-established levels for use (generally from 0% to about 20% of the detergent ingredients, preferably from about 0.5% to about 10%), include other active ingredients such as dispersant polymers from BASF Corp. or Rohm & Haas; dye transfer inhibitors such as polyvinylpyrrolidone or polyvinylpyrrolidone N-Oxide; optical brighteners or fluorescers, color speckles, anti-corrosion agents, dyes, fillers, germicides, alkalinity sources, hydrotropes, anti-oxidants, enzyme stabilizing agents, perfumes, solubilizing agents, carriers, processing aids, pigments, and, for liquid formulations, solvents.

pH and Buffering Variation—Many detergent compositions herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art. Detergent compositions herein in granular form typically limit water content, for example to less than about 7% free water, for best storage stability.

Storage stability of detergent compositions can be further enhanced by limiting the content in the compositions of adventitious redox-active substances such as rust and other traces of transition metals in undesirable form. Certain compositions may moreover be limited in their total halide ion content, or may have any particular halide, e.g., bromide, substantially absent. Bleach stabilizers such as stannates can be added for improved stability and formulations may be substantially nonaqueous if desired.

EXAMPLE 1

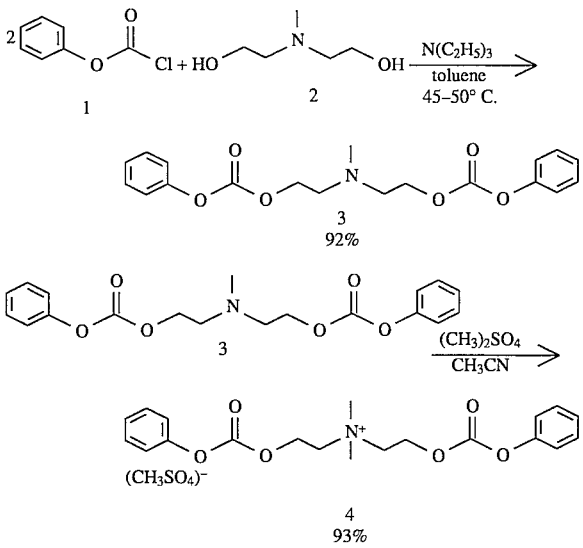

Preparation of N,N-Bis[2-((phenoxycarbonyl)oxy)ethyl]-N-methylamine (3).

To a 500 ml three-necked round-bottomed flask equipped with an internal thermometer, reflux condenser, mechanical stirrer, addition funnel, and argon inlet are added N-methyldiethanolamine (20.00 g, 0.168 mol), toluene (200 ml), and triethylamine (37.36 g, 0.369 mol). The mixture is treated with a solution of phenylchloroformate (52.56 g, 0.336 mol) dissolved in 50 ml of toluene so as to maintain the reaction temperature at 35°–45° C. After addition is complete, the mixture is heated at 45° C. for an additional 1.5 h. The cooled mixture is washed with saturated sodium bicarbonate solution (2×200 ml) and water (200 ml). The organic phase is dried over $MgSO_4$, filtered, and concentrated first by rotary evaporation at 50° C. (water aspirator vacuum) and then at 80° C. (0.02 mmHg) in a Kugelrohr oven to give 3 as a light yellow oil, 55.65 g (92%) that crystallizes on standing. Preparation of N,N-Bis[2-((phenoxycarbonyl)oxy)ethyl]-N,N-dimethylammonium Methylsulfate (4). To a 1000 ml three-necked round-bottomed flask fitted with a reflux condenser, magnetic stirrer, internal thermometer, addition funnel, and argon inlet are added N,N-bis[2-((phenoxycarbonyl)oxy)ethyl]-N-methylamine (100.00 g, 0.278 mol), acetonitrile (270 ml), and dimethylsulfate (35.93 g, 0.278 mol) over 10 min. After addition is complete, the mixture is heated to reflux for 2 h. The cooled mixture is treated with ether (500 ml). The product precipitates from the mixture after approximately 15 min to give 4 as a white powder, 126.26 g (93%): mp 85°–87° C.

EXAMPLE 2

Preparation of N,N-Bis[2-((phenoxycarbonyl)oxy)ethyl]-N,N-dimethylammonium p-Toluene-sulfonate (5).

To a 250 ml round-bottomed flask fitted with a reflux condenser, magnetic stirrer, and argon inlet are added N,N-bis[2((phenoxycarbonyl)oxy)ethyl]-N-methylamine (25.00 g, 69.6 mmol), acetonitrile (100 ml), and methyl p-toluenesulfonate (12.95 g, 69.6 mmol). After addition is complete, the mixture is heated to reflux for 2 h. The cooled mixture is treated with ether (500 ml). The product precipitates from the mixture and dried to give 5 as a white powder, 31.14 g (81%): mp 117°–118° C.

EXAMPLE 3

Preparation of N,N-Bis[2-((phenoxycarbonyl)oxy)ethyl]-N,N-dimethylammonium Chloride (6).

To a 500 ml autoclave liner are added N,N-bis[2-((phenoxycarbonyl)oxy)ethyl]-N-methylamine (20.20 g, 56.2 mmol) and acetonitrile (25 ml). The liner is placed in an autoclave and the solution is treated with methyl chloride gas at 85° C. and at a pressure of 60 psig. After 18 h, the cooled mixture is treated with ether (500 ml) precipitaing 6 as a white powder, 19.16 g (83%): mp 148°–150° C.

EXAMPLE 4

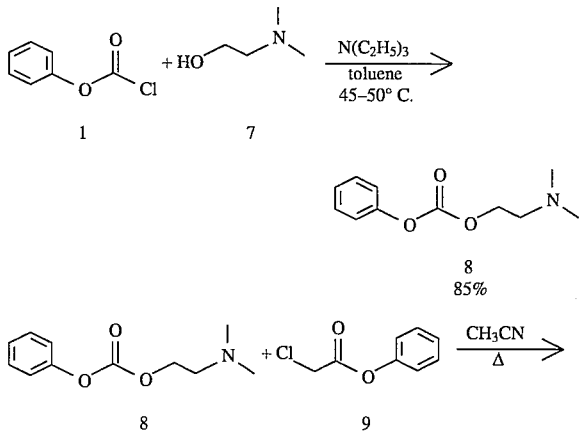

-continued

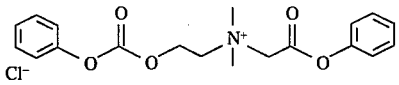

10

51%

Preparation of N-[2-((Phenoxycarbonyl)oxy)ethyl]-N,N-dimethylamine (8).

To a 500 ml three-necked round-bottomed flask equipped with an internal thermometer, reflux condenser, mechanical stirrer, addition funnel, and argon inlet are added N,N-dimethylethanolamine (25.00 g, 0.281 mol), toluene (200 ml), and triethylamine (31.21 g, 0.309 mol). The mixture is treated with a solution of phenylchloroformate (43.91 g, 0.281 mol) dissolved in 50 ml of toluene over 15 min. After addition is complete, the mixture is heated to reflux for 3 h. The cooled mixture is washed with saturated sodium bicarbonate solution (2×100 ml) and water (100 ml). The organic phase is dried over $MgSO_4$, filtered, and concentrated first by rotary evaporation at 50° C. (water aspirator vacuum) and then at 60° C. (0.05 mmHg) in a Kugelrohr oven to give 8 as a light yellow oil, 49.93 g (85%) that crystallizes on standing.

Preparation of N-[2-((Phenoxycarbonyl)oxy)ethyl]-N-((phenoxycarbonyl)methyl)-N,N-dimethyl-ammonium Chloride (10).

To a 250 ml three-necked round-bottomed flask fitted with a reflux condenser, magnetic stirrer, internal thermometer, addition funnel, and argon inlet are added N-[2-((phenoxycarbonyl)oxy)ethyl]-N,N-dimethylamine (25.00 g, 0.120 mol), acetonitrile (100 ml), and phenyl chloroacetate (20.38 g, 0.120 mol) over 5 min. After addition is complete, the mixture is heated to reflux for 3 h. The cooled mixture is triturated with ether (500 ml). A white solid, 23.15 g (51%) is isolated to give 9.

EXAMPLE 5

Preparation of N,N-Bis-[2-((phenoxycarbonyl)oxy)ethyl]-N-ethyl-N-methylammonium p-Toluene-sulfonate (11).

The synthesis of Example 2 is repeated with the substitution of ethyl p-toluenesulfonate for methyl p-toluenesulfonate.

EXAMPLE 6

Preparation of N,N-Bis-[2-((phenoxycarbonyl)oxy)ethyl]-N-methyl-N-benzylammonium Chloride (12).

The synthesis of Example 2 is repeated with the substituion of benzyl chloride for methyl p-toluenesulfonate.

EXAMPLE 7

Preparation of N,N,N-Tris-[2-((phenoxycarbonyl)oxy-)ethyl]-N-methylammonium Methylsulfate (13).

The synthesis of Example 1 is repeated with the substituion of triethanolamine for N-methyldiethanolamine.

EXAMPLE 8

Preparation of N,N,N-Tris-[2-((phenoxycarbonyl)oxy-)isopropyl]-N-methylammonium Methylsulfate (14).

The synthesis of Example 1 is repeated with the substituion of triisopropanolamine for N-methyldiethanolamine.

EXAMPLE 9

Preparation of N-[2,3-Bis[(phenoxycarbonyl)oxy]propyl]-N,N,N-trimethylammonium Methylsulfate (15).

The synthesis of Example 1 is repeated with the substituion of (+)-3-(dimethylamino)-1,2-propanediol for N-methyldiethanolamine.

EXAMPLE 10

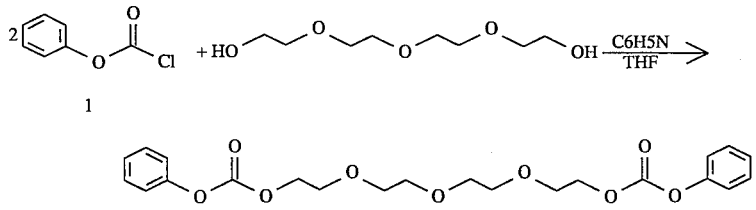

1

16

Preparation of Bis(phenoxycarbonyl) Tetraethylene Glycol (16).

To a 250 ml round-bottomed flask equipped with a mechanical stirrer, addition funnel, and argon inlet are added tetraethylene glycol (2.69 g), pyridine (2.44 g) and tetrahydrofuran (10 ml). The solution is chilled in an ice bath and charged dropwise with phenylchloroformate (4.87 g) over a period of twenty minutes. After addition is complete, the ice bath is removed and the mixture is allowed to stir overnight at room temperature. The mixture is vacuum filtered through a glass-fritted filter. The filtrate is concentrated by rotary evaporation, diluted with diethyl ether (100 ml) and subsequently vacuum filtered. The filtrate is washed with deionized water (100 ml) and saturated sodium chloride solution (100 ml). The organic phase is dried over $MgSO_4$, filtered, and concentrated by rotary evaporation to give a viscous, clear oil 3.84 g (64%).

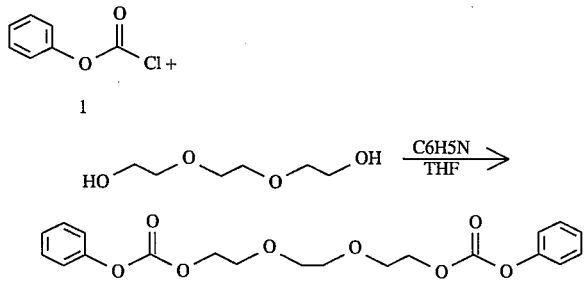

1

17

Preparation of Bis(phenoxycarbonyl) Triethylene Glycol (17).

Bis(phenoxycarbonyl) triethylene glycol is prepared as for bisphenolcarbonyl) tetraethylene glycol (Example 10) using triethylene glycol in place of tetraethylene glycol.

EXAMPLE 12

Granular laundry detergent compositions illustrating the invention are as follows:

| INGREDIENT | A % | B % | C % | D % | E % |
|---|---|---|---|---|---|
| Bleach Activator* | 5 | 1 | 3 | 3 | 8 |
| Sodium Percarbonate | 0 | 10 | 5 | 21 | 0 |
| Sodium Perborate monohydrate | 20 | 1 | 10 | 0 | 20 |
| Sodium Perborate tetrahydrate | 0 | 2 | 0 | 0 | 0 |
| Tetraacetylethylenediamine | 0 | 0 | 0 | 0 | 3 |
| Nonanoyloxybenzenesulfonate Na salt | 0 | 2 | 3 | 0 | 0 |
| Linear alkylbenzenesulfonate | 5 | 0 | 19 | 0 | 12 |
| N-cocoyl N-methyl glucamin | 5 | 8 | 0 | 0 | 0 |
| Alkyl ethoxylate (C45E7) | 5 | 5 | 1 | 9 | 4 |
| Zeolite A | 20 | 10 | 7 | 10 | 21 |
| SKS-6 ® silicate (Hoechst) | 0 | 0 | 11 | 11 | 0 |
| Trisodium citrate | 5 | 5 | 2 | 13 | 3 |
| Acrylic Acid/Maleic Acid copolymer | 4 | 0 | 4 | 5 | 0 |
| Sodium polyacrylate | 0 | 3 | 0 | 0 | 3 |
| Diethylenetriamine penta-(methylene phosphonic acid) | 0.4 | 0 | 0.4 | 0 | 0 |
| DTPA | 0 | 0.4 | 0 | 0 | 0.4 |
| EDDS | 0 | 0 | 0 | 0.3 | 0 |
| Carboxymethylcellulose | 0.3 | 0 | 0 | 0.4 | 0 |
| Protease | 1.4 | 0.3 | 1.5 | 2.4 | 0.3 |
| Lipolase | 0.4 | 0 | 0 | 0.2 | 0 |
| Anionic soil release polymer | 0.3 | 0 | 0 | 0.4 | 0.5 |
| Dye transfer inhibiting polymer | 0 | 0 | 0.3 | 0.2 | 0 |
| Sodium Carbonate | 16 | 14 | 21 | 6 | 23 |
| Sodium Silicate | 3.0 | 0.6 | 12. | 0 | 0.6 |
| Sulfate, Water, Perfume | 100 | 100 | 100 | 100 | 100 |
| Colorants to: | | | | | |

*Bleach Activator according to any of Examples 1–11.

EXAMPLE 13

Cleaning compositions having liquid form especially useful for cleaning bathtubs and shower tiles are as follows:

| Ingredient | % (wt.) A | B |
|---|---|---|
| Bleach Activator* | 7.0 | 5.0 |
| Hydrogen Peroxide | 10.0 | 10.0 |
| $C_{12}AS$, acid form, partially neutralized | 5.0 | 5.0 |
| $C_{12-14}AE_3S$, acid form, partially neutralized | 1.5 | 1.5 |
| $C_{12}$ Dimethylamine N-Oxide | 1.0 | 1.0 |
| DEQUEST 2060 | 0.5 | 0.5 |
| Citric acid | 5.5 | 6.0 |
| Abrasive (15–25 micron) | 15.0 | 0 |
| HCl | to pH 4 | |
| Filler and water | Balance to 100% | |

*Bleach Activator according to any of Examples 1–11, coated with impermeable film.

EXAMPLE 14

Liquid bleaching compositions for cleaning typical household surfaces are as follows. The hydrogen peroxide is separated as an aqueous solution from the other components by any suitable means such as a dual-chamber container.

| Component | A (wt %) | B (wt %) |
|---|---|---|
| $C_{8-10}E_6$ nonionic surfactant | 20 | 15 |
| $C_{12-13}E_3$ nonionic surfactant | 4 | 4 |
| $C_8$ alkyl sulfate anionic | 0 | 7 |
| $C_8$ alkyl sulfate anionic surfactant | | |
| $Na_2CO_3/NaHCO_3$ | 1 | 2 |
| $C_{12-18}$ Fatty Acid | 0.6 | 0.4 |
| Hydrogen peroxide | 7 | 7 |
| Bleach Activator* | 7 | 7 |
| DEQUEST 2060** | 0.05 | 0.05 |
| $H_2O$ | Balance to 100 | Balance to 100 |

*Bleach Activator according to any of Examples 1–11.
**Commercially available from Monsanto Co.

EXAMPLE 15

A laundry bar suitable for hand-washing soiled fabrics is prepared by standard extrusion processes and comprises the following:

| Component | Weight % |
|---|---|
| Bleach Activator according to any of Examples 1–11 | 2 |
| Sodium Perborate Tetrahydrate | 12 |
| $C_{12}$ linear alkyl benzene sulfonate | 30 |
| Phosphate (as sodium tripolyphosphate) | 10 |
| Sodium carbonate | 5 |
| Sodium pyrophosphate | 7 |
| Coconut monoethanolamide | 2 |
| Zeolite A (0.1–10 micron) | 5 |
| Carboxymethylcellulose | 0.2 |
| Polyacrylate (m.w. 1400) | 0.2 |
| Brightener, perfume | 0.2 |
| $CaSO_4$ | 1 |
| $MgSO_4$ | 1 |
| Water | 4 |
| Filler* | Balance to 100% |

*Can be selected from convenient materials such as $CaCO_3$, talc, clay, silicates, and the like. Fabrics are washed with the bar with excellent results.

What is claimed is:

1. A detergent composition comprising:

i) from about 0.1% to about 30% by weight of a bleach activator having the formula:

$$[R^1\underset{4-x}{\rightharpoonup}\overset{\oplus}{N}+R^2-G]_xZ_j \qquad (I)$$

wherein x is an integer from 2 to 4; each G is independently selected from the group consisting of $$-\overset{O}{\overset{\|}{C}}-L,\quad -O-\overset{O}{\overset{\|}{C}}-L',\quad \text{and}\quad -\overset{NR^3}{\overset{\|}{C}}-L''$$

provided that at least one G is $$-O-\overset{O}{\overset{\|}{C}}-L';$$

and wherein $R^3$, when present, is selected from $C_1$–$C_{12}$ alkyl and $C_6$–$C_{12}$ aryl and wherein L, L' and L" are leaving groups; L' being selected from the group consisting of

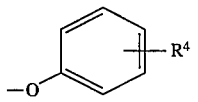

wherein $R^4$ is selected from $—CO_2R_5$ and $—OR^5$ wherein $R^5$ is selected from $C_1$–$C_{12}$ alkyl; L and L" being selected from the group consisting of

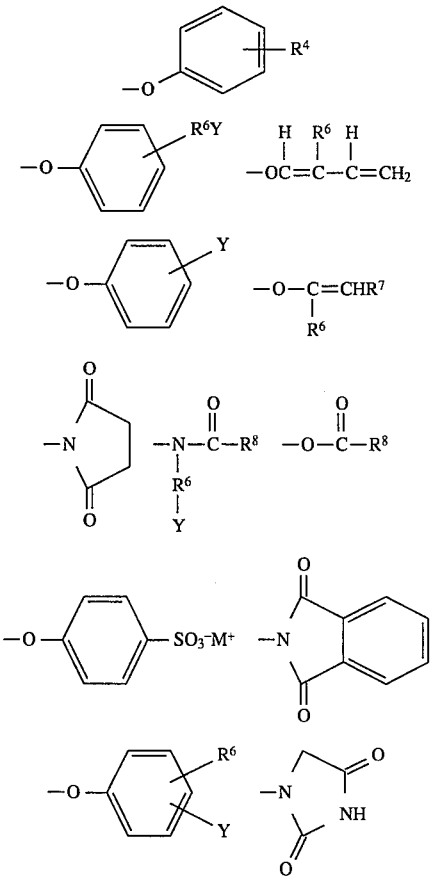

wherein R4 is selected from $—CO_2R^5$ and $—OR^5$ wherein $R^5$ is selected from $C_1$–$C_{12}$ alkyl; Y is selected from $—(SO_3^-)M$, $—(C(O)O)^-M$, $—(C(O)OR^6)$, $—(SO_4^{2-})M$, $—(NR6)3)^+X$, $—NO_2$, —OH, O $N(R^6)_2$ and mixtures thereof; $X^-$ is an oxidation compatible anion; M is selected from sodium, potassium and ammonium; $R^6$ and $R^7$ are selected from $C_1$–$C_{12}$ alkyl and hydrogen; $R^8$ is selected from $C_1$–$C_{12}$ alkyl; each $R^1$ is independently selected from the group consisting of alkyl, alkenyl, alkynyl, cycloalkyl, cycloalkenyl, alkaryl, aryl, phenyl, hydroxyalkyl, and polyoxyalkylene; each $R^2$ is independently selected from alkylene, cycloalkylene, alkylenephenylene, phenylene, arylene, alkoxyalkylene, polyalkoxy-alkylene, and hydroxyalkylene, any $R^2$ being substituted with a moiety selected from H, $C_1$–$C_{20}$ alkyl, alkenyl, aryl, aralkyl, and alkaryl; Z is an oxidation compatible ion; and j is selected such that said bleach activator is electrically neutral; and ii) from about 0.1% to about 70% by weight of a source of hydrogen peroxide.

2. A detergent composition according to claim 1 wherein said bleach activator has the formula (I) wherein x is 2 or 3; all moieties G are selected from $$—\overset{O}{\overset{\|}{C}}—L \quad \text{and} \quad —O—\overset{O}{\overset{\|}{C}}—L';$$

$R^1$ is $C_1$–$C_8$ alkyl, benzyl, 1-naphthylmethylene or 2-naphthylmethylene provided that no more than one $R^1$ is different from $C_1$–$C_4$ alkyl; $R^5$ is methyl.

3. A detergent composition according to claim 2 wherein said bleach activator has the formula (I) wherein x is 2; each G is $$—O—\overset{O}{\overset{\|}{C}}—L';$$

$R^1$ is $C_1$–$C_4$ alkyl or benzyl; $R^2$ is ethylene or propylene; and $R^4$ is methyl.

4. A detergent composition according to claim 1 wherein said composition has an aqueous pH in the range from about 7 to about 12.

5. A detergent composition according to claim 4 further comprising a conventional bleach activator.

6. A detergent composition according to claim 5 wherein said conventional bleach activator is selected from the group consisting of tetraacetylethylenediamine, nonanoyloxybenzenesulfonate, and mixtures thereof.

7. A detergent composition according to claim 6 wherein said conventional bleach activator is nonanoyloxybenzenesulfonate.

8. A detergent composition according to claim 7 further comprising from about 0.0001% to about 10% of a detersive enzyme.

9. A detergent composition according to claim 8 which is substantially free from phosphate builders and chlorine bleach.

10. A detergent composition according to claim 9 wherein said composition is a hardsurface cleaning detergent composition.

11. A detergent composition according to claim 9 wherein said composition is a laundry detergent composition.

* * * * *

UNITED STATES PATENT AND TRADEMARK OFFICE

CERTIFICATE OF CORRECTION

PATENT NO. : 5,595,967
DATED : January 21, 1997
INVENTOR(S) : Gregory S. Miracle et al.

It is certified that error appears in the above-identified patent and that said Letters Patent is hereby corrected as shown below:

Title page,
Notice [*] "Pat. No. 5,591,704" should read -- Pat. No. 5,616,546 --.

Signed and Sealed this

Second Day of July, 2002

*Attest:*

*Attesting Officer*

JAMES E. ROGAN
*Director of the United States Patent and Trademark Office*